US008215934B2

(12) United States Patent
Edlund et al.

(10) Patent No.: US 8,215,934 B2
(45) Date of Patent: Jul. 10, 2012

(54) PNEUMATIC VANE MOTOR WITH IMPROVED SEALING

(75) Inventors: Sven Olov Roger Edlund, Östersund (SE); Heino Elmessaar, Lidingö (SE); Johan Fredrik Lindgren, Stockholm (SE); Hans Reinhold Svedman, Saltsjö-Boo (SE)

(73) Assignee: Atlas Copco Tools AB, Nacka (SE)

( * ) Notice: Subject to any disclaimer, the term of this patent is extended or adjusted under 35 U.S.C. 154(b) by 737 days.

(21) Appl. No.: 12/444,964

(22) PCT Filed: Oct. 16, 2007

(86) PCT No.: PCT/SE2007/000906

§ 371 (c)(1),
(2), (4) Date: Apr. 9, 2009

(87) PCT Pub. No.: WO2008/048165

PCT Pub. Date: Apr. 24, 2008

(65) Prior Publication Data

US 2010/0092325 A1 Apr. 15, 2010

(30) Foreign Application Priority Data

Oct. 16, 2006 (SE) ..... 0602160

(51) Int. Cl.
*F01C 19/00* (2006.01)
*F04C 15/00* (2006.01)

(52) U.S. Cl. ..... 418/104; 173/98; 173/168

(58) Field of Classification Search ..... 418/104, 418/270; 173/168, 98
See application file for complete search history.

(56) References Cited

U.S. PATENT DOCUMENTS

| | | | | |
|---|---|---|---|---|
| 2,373,669 | A * | 4/1945 | Sturrock | 418/213 |
| 2,414,638 | A * | 1/1947 | Dobie | 418/1 |
| 2,980,078 | A * | 4/1961 | Conover, Jr. | 418/82 |
| 3,429,230 | A | 2/1969 | Quackenbush | |
| 4,197,061 | A * | 4/1980 | Hill | 418/270 |
| 5,142,952 | A | 9/1992 | Putney et al. | |
| 6,158,528 | A | 12/2000 | Izumisawa | |
| 6,401,836 | B1 | 6/2002 | Heinrichs et al. | |
| 6,695,072 | B2 | 2/2004 | Izumisawa | |
| RE39,009 | E | 3/2006 | Izumisawa | |
| 2003/0121680 | A1 | 7/2003 | Izumisawa et al. | |
| 2007/0151075 | A1 | 7/2007 | Izumisawa et al. | |

OTHER PUBLICATIONS

English Language International Search Report dated Jan. 24, 2008 issued in parent Appln. No. PCT/SE2007/000906.

* cited by examiner

*Primary Examiner* — Mary A Davis
(74) *Attorney, Agent, or Firm* — Holtz, Holtz, Goodman & Chick, PC

(57) ABSTRACT

A pneumatic vane motor includes a stator with a cylinder, an inlet connectable to a pressure air source and an outlet connectable to an exhaust passage, a rotor journalled in the stator, and an output shaft. The stator has a front opening forming a clearance seal relative to the output shaft and an annular front cover with at least one elastic annular seal element encircling the output shaft at a distance from the clearance seal, wherein a low pressure chamber is formed between the clearance seal and the seal element or elements and communicates with the exhaust passage.

5 Claims, 1 Drawing Sheet

PNEUMATIC VANE MOTOR WITH IMPROVED SEALING

This application is a U.S. National Phase Application under 35 USC 371 of International Application PCT/SE2007/000906 filed Oct. 16, 2007.

The invention relates to a pneumatic vane motor having a stator with a cylinder, and a rotor journalled in the stator and having an output end extending out of the cylinder to form an output shaft, wherein a seal means is provided between the stator and the rotor to prevent air leakage from the cylinder.

A problem concerned with the above type of motors is to find a seal means between the stator and the output shaft which is durable and tight enough against air leakage. Commonly used seal devices comprise different sorts of elastic rings which engage the output shaft with a quite heavy clamp force to ensure tightness against leakage. There is required quite a heavy clamp force of these seal rings to be leakage proof, because they are usually exposed to the relatively high air pressure within the stator cylinder. The result is that those seal rings, due to the heavy clamp force, generate considerable frictional resistance and is mechanically worn down rather rapidly. This means not only a reduced efficiency of the motor due to lost torque but also a limited service life of the rotor seal resulting in shortened and costly service intervals of the motor.

The main object of the invention is to provide a pneumatic vane motor with an output shaft seal means that is very tight against air leakage, has low friction characteristics and a long service life, and avoids reduction of the motor efficiency due to frictional losses.

Further characteristic features and advantages of the invention will appear from the following specification and claims.

A preferred embodiment of the invention is described below with reference to the accompanying drawing.

In the drawing

Figure 1:
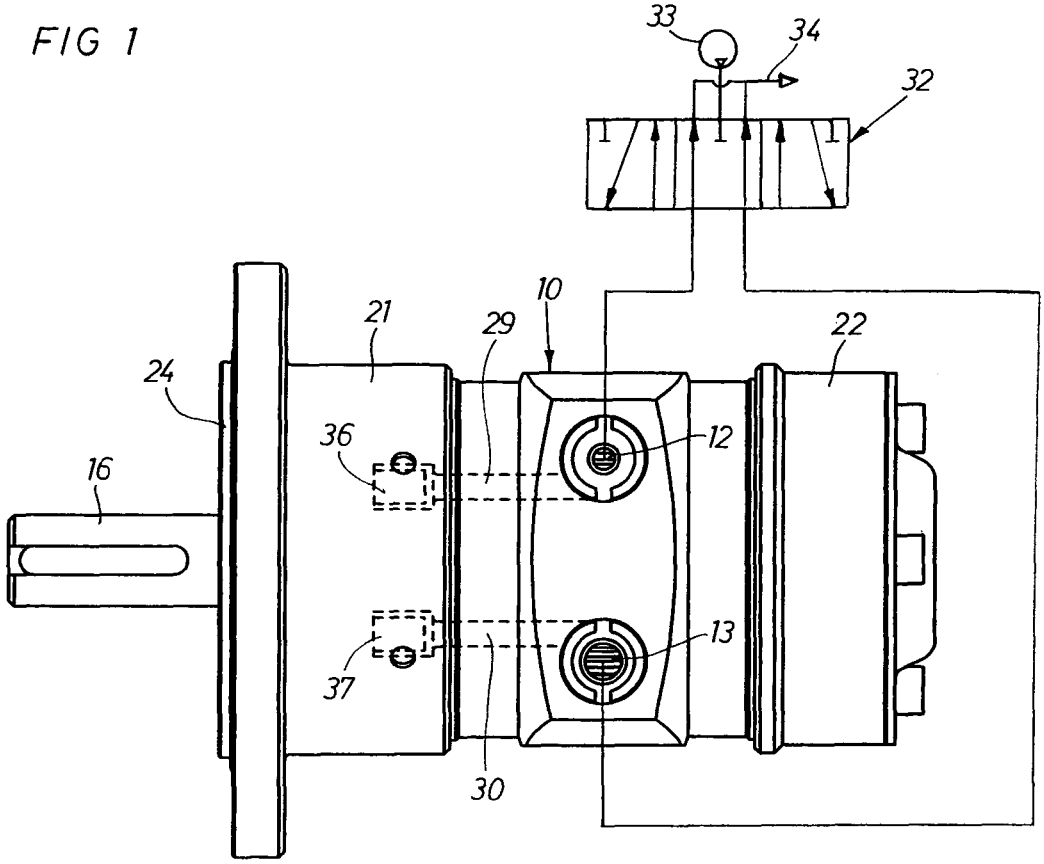
FIG. 1 shows a top view of a pneumatic motor with a schematically illustrated reverse valve connection according to the invention.
Figure 2:
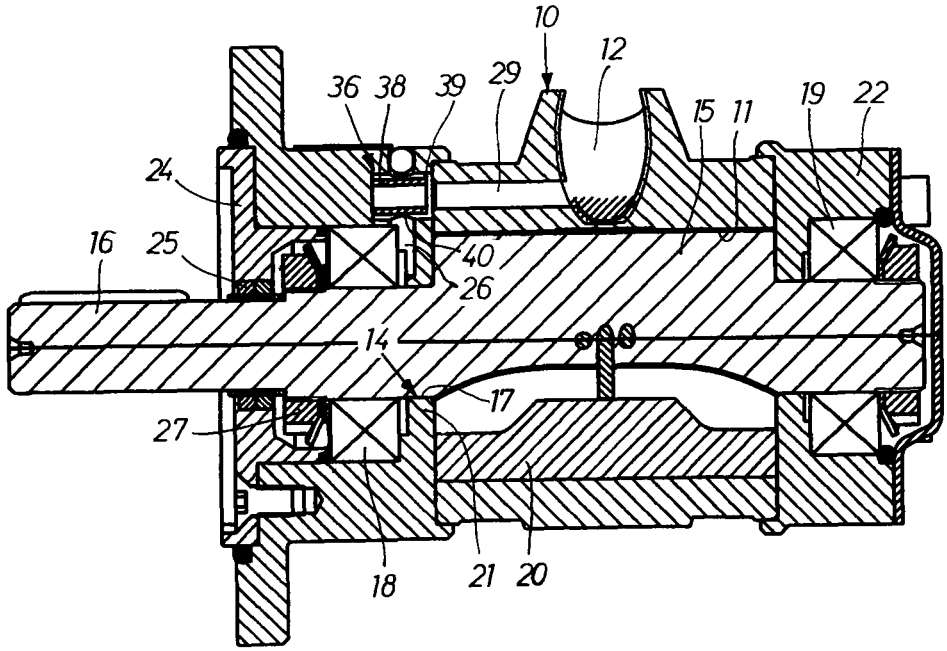
FIG. 2 shows a longitudinal section through the motor in FIG. 1.

The motor illustrated in the drawing comprises a stator 10 with a cylinder 11, an inlet port 12 and an outlet port 13. A rotor 15 is journalled in the stator 10 via ball bearings 18, 19 supported in opposite end walls 21, 22 of the stator 10, and the rotor 15 is formed with an extension which forms an output shaft 16 protruding out through a front opening 17 in the stator end wall 21. The rotor 15 also carries a number of sliding vanes 20 for co-operation with the cylinder 11.

The arrangement of the driving parts of the motor including the excentric cylinder and the rotor vanes are of a well known common design and are therefore not described in further detail.

Moreover, the end wall 21 is provided with an annular end cover 24 on which is mounted a double seal ring 25 of an elastic material to form a seal barrier around the output shaft 16. In the stator opening 17 there is arranged a clearance seal 14 between the stator 10 and the output shaft 16, and the seal ring 25 is located outside and at a distance from the end wall opening 17, wherein between clearance seal 14 and the seal ring 25 there is formed a low pressure chamber 26. The low pressure chamber 26 contains the bearing 18 and a retaining nut 27 for the rotor 15.

The inlet port 12 and the outlet port 13 are both connected to the low pressure chamber 26 via a first communication passage 29 and second communication passage 30, respectively, and a reverse valve 32 is arranged to connect the inlet port 12 and the outlet port 13 alternatively to a pressure air source 33 and an exhaust passage 34. This means that the motor is reversible such that depending on the position of the reverse valve 32 the inlet port 12 or the outlet port 13 are alternatively connected to the pressure air source, whereas the other one of these ports is vented through the exhaust passage 34.

In order to prevent pressure air from entering into the low pressure chamber 26 there are provided two check valves 36, 37 in the communication passages 29, 30. These check valves 36, 37 are arranged to block air flow into the low pressure chamber 26 from the ports 12, 13 but to keep open paths for air flow out from the chamber 26. Each check valve 36, 37 comprises an elastic tubular valve element 38 mounted lengthwise in a tubular valve chamber 39, and a lateral opening 40 in the valve chamber 39 is controlled by the valve element 38 such that when the pressure within the low pressure chamber 26 is higher than the pressure in the communication passage 30 presently acting as outlet passage the valve element 38 will yield radially and uncover the opening 40, thereby letting through an air flow towards the passage 30. If on the other hand the pressure in the passage 30 is higher than that in the low pressure chamber 26 due to connection of port 13 to the pressure air source the valve element 38 will be deformed in the opposite direction and close the opening 40, thereby preventing air from entering the low pressure chamber 26. The tiny leakage flow entering the low pressure chamber 26 via the clearance seal 14 is effectively drained to the atmosphere via the opening 40, either one of the check valves 36, 37 and the passages 12, 13.

Due to the provision of the check valve controlled low pressure chamber 26 the pressure to be dealt with by the seal ring 25 is very low and requires a light fit only. This means in turn a low friction engagement with the output shaft 16 with low friction losses, no reduction of the motor efficiency, and a considerably extended service life of the seal ring 25.

The invention claimed is:

1. Pneumatic vane motor, comprising: a stator with a cylinder, an inlet connectable to a pressure air source and an outlet connectable to an exhaust passage, a rotor journalled relative to the cylinder and having an extension protruding from the stator and forming an output shaft, and a seal system arranged between the output shaft and the stator, wherein the seal system comprises: a clearance seal formed between the stator and the output shaft at a point close to the cylinder, at least one elastic annular seal element carried by the stator and engaging the output shaft at a point outside and at an axial distance from said clearance seal, and a low pressure chamber formed between said clearance seal and said at least one elastic annular seal element, wherein said low pressure chamber communicates with the exhaust passage.

2. The pneumatic vane motor according to claim 1, wherein a reverse valve is arranged to connect the inlet alternatively to the pressure air source and the exhaust passage, and the outlet alternatively to the pressure air source and the exhaust passage at a forward operation mode and at a reverse operation mode, respectively, of the motor, wherein a valve device is provided to ensure communication between said low pressure chamber and the exhaust passage irrespective of operation mode of the motor.

3. The pneumatic vane motor according to claim 2, wherein said low pressure chamber is connected to the inlet via a first communication passage and to the outlet via a second communication passage, and said valve device comprises a first check valve located in said first communication passage, and a second check valve located in said second communication passage, wherein said first and second check valves are arranged to prevent pressure air from the pressure air source from reaching said low pressure chamber but to ensure that the low pressure chamber always communicates with the exhaust passage, irrespective of the operation mode of the motor.

4. The pneumatic vane motor according to claim 3, wherein each one of said first and second check valves comprises a tubular valve chamber communicating with either one of the inlet or the outlet and provided with a lateral opening communicating with said low pressure chamber, and a tubular valve element of an elastically deformable material disposed coaxially in said tubular valve chamber and arranged to control the air flow through said lateral opening.

5. The pneumatic vane motor according to claim 4, wherein said tubular valve element of either one or both of said first and second check valves has a nominal outer diameter that is smaller than the diameter of said tubular valve chamber to provide free passage of air out of said low pressure chamber through said lateral opening.

* * * * *